US006085958A

United States Patent [19]

Kersten

[11] Patent Number: 6,085,958

[45] Date of Patent: Jul. 11, 2000

[54] EXPLOSIVE POWDER CHARGE OPERATED BOLT-SETTING TOOL

[75] Inventor: Olaf Kersten, Krefeld, Germany

[73] Assignee: Berner GmbH, Kunzelsau, Germany

[21] Appl. No.: 09/094,166

[22] Filed: Jun. 9, 1998

[51] Int. Cl.[7] ..... B25C 1/14

[52] U.S. Cl. ..... 227/10; 227/130; 173/212

[58] Field of Search ..... 227/10, 9, 11, 227/130; 173/212; 91/401; 89/1.14; 60/638

[56] References Cited

U.S. PATENT DOCUMENTS

| | | | |
|---|---|---|---|
| 2,877,750 | 3/1959 | Maier | 60/638 |
| 3,044,071 | 7/1962 | Behrend | 227/10 |
| 3,255,942 | 6/1966 | Bell et al. | 227/10 |
| 3,297,224 | 1/1967 | Osborne | 227/10 |
| 3,469,504 | 9/1969 | Neighorn | 173/212 |
| 3,496,840 | 2/1970 | Wandel et al. | 227/130 |
| 3,690,536 | 9/1972 | Bakoledis | 227/10 |
| 3,744,240 | 7/1973 | Henning et al. | 60/638 |
| 3,815,475 | 6/1974 | Howard et al. | 91/401 |
| 4,358,041 | 11/1982 | Ollivier | 227/9 |
| 4,374,567 | 2/1983 | Combette et al. | 227/9 |
| 4,711,385 | 12/1987 | Jochum | 227/10 |
| 4,753,151 | 6/1988 | Peterson | 89/1.14 |
| 4,824,003 | 4/1989 | Almeras et al. | 227/10 |
| 4,941,391 | 7/1990 | Ehmig et al. | 227/10 |
| 5,170,922 | 12/1992 | Ehmig et al. | 227/10 |
| 5,538,172 | 7/1996 | Jochum et al. | 227/10 |
| 5,797,534 | 8/1998 | Almeras et al. | 227/10 |

FOREIGN PATENT DOCUMENTS

| | | |
|---|---|---|
| 460558 | 4/1975 | Australia . |
| 0223740 | 11/1986 | European Pat. Off. . |
| 0274957 | 12/1987 | European Pat. Off. . |
| 1289689 | 3/1961 | France . |
| 1177087 | 8/1964 | Germany . |

*Primary Examiner*—Peter Vo
*Assistant Examiner*—James P. Calve
*Attorney, Agent, or Firm*—Douglas J. Christensen

[57] ABSTRACT

The invention relates to a pyrotechnically operated bolt-setting tool having a barrel (11, 12) which is guided in a barrel-guiding sleeve (1) and can be brought into operative engagement with a locking part (18), the barrel-guiding bore (26) of which accommodates a piston (21), which has a piston shank (23) and a piston head (22), and which has a cartridge store (16) on that side which is remote from the mouth, in which tool the rear side of the piston head (22) is connected through the piston (21) to its front side in such a manner that some of the combustion gases are guided to the front side of the piston head (22), and in which the barrel (11, 12), on its side which faces the cartridge store (16), has ventilation slots (31) which are released by the piston head (22) as the bolt is being fired, before the piston (21) reaches its end position on the mouth side, in which position a gas cushion is compressed between the piston head (22) and the barrel (11, 12), which gas cushion subsequently presses the piston (21) back into its starting position.

18 Claims, 2 Drawing Sheets

EXPLOSIVE POWDER CHARGE OPERATED BOLT-SETTING TOOL

BACKGROUND OF THE INVENTION

The invention relates to an explosive powder charge operated setting suitable for setting bolts.

Non-repeating, explosive powder charge operated bolt-setting tools are known (published European Patent Application No. 0,223,740), in which combustion gases, which are produced after setting of the cartridge, are used in order to guide the piston back into its starting position. However, in this case there are complicated gas bypasses having valves and seals and their ability to function is moreover adversely affected by combustion residues which are entrained by the combustion gases. A series of parts has to be manufactured in this case with great accuracy because of the seal tightness required.

German Patent Publication No. 1,177,087 furthermore discloses a pyrotechnically operated bolt-setting tool having a barrel which is guided in a barrel-guiding sleeve, can be brought into operative engagement with a locking part, the barrel-guiding bore of which accommodates a multi-part piston, whose part on the mouth side has a piston shank and a piston head, and which has a cartridge store on that side which is remote from the mouth. In addition, the piston has a so-called hammer, consisting of a bushing and a shank, which serves to reduce the recoil which occurs as the bolt is being fired, to such an extent that the tool does not lift off from the wall when the bolt is penetrating thereto. In this case, to avoid the piston movements being damped to an undesirably high extent, the circumference of the piston head is provided with grooves which connect the spaces in front of and behind the piston head to one another. However, this is not a non-repeating tool and so the piston is not guided back into its starting position by using the combustion gases.

SUMMARY OF THE INVENTION

The invention relates to a pyrotechnically operated bolt-setting tool having a barrel (11, 12) which is guided in a barrel-guiding sleeve (1) and can be brought into operative engagement with a locking part (18), the barrel-guiding bore (26) of which accommodates a piston (21), which has a piston shank (23) and a piston head (22), and which has a cartridge store (16) on that side which is remote from the mouth, in which tool the rear side of the piston head (22) is connected through the piston (21) to its front side in such a manner that some of the combustion gases are guided to the front side of the piston head (22), and in which the barrel (11, 12), on its side which faces the cartridge store (16), has ventilation slots (31) which are released by the piston head (22) as the bolt is being fired, before the piston (21) reaches its end position on the mouth side, in which position a gas cushion is compressed between the piston head (22) and the barrel (11, 12), which gas cushion subsequently presses the piston (21) back into its starting position.

It is an object of the present invention to provide a bolt-setting tool of a simplified construction.

It is a further object of the present invention to provide a setting tool using combustion gases for guiding back its position into its starting position.

In accordance with the invention, the combustion gases are conducted through the piston head in a restricted manner from its rear side to its front side where they pass via outlet openings into an annular space between the piston shank and barrel-guiding bore for the piston, and form a gas cushion there. These outlet openings are surrounded by an annular spring which closes the outlet openings whenever the pressure in the annular space at the front side of the piston is greater than that at the rear side. The formation of the gas cushion is assisted by the air contained in the annular space and compressed by the piston movement. This gas cushion does not only intercept the piston but also acts as a gas spring, since the pressure behind the piston drops, due to the release of corresponding ventilation slots in the barrel, before the pressure of the gas cushion, with the result that the latter is thereby guided back into its starting position.

These and other objects and features of the invention will be understood upon consideration of the following detailed description of the invention and the accompanied drawings.

DETAILED SPECIFICATION

Figure 1:
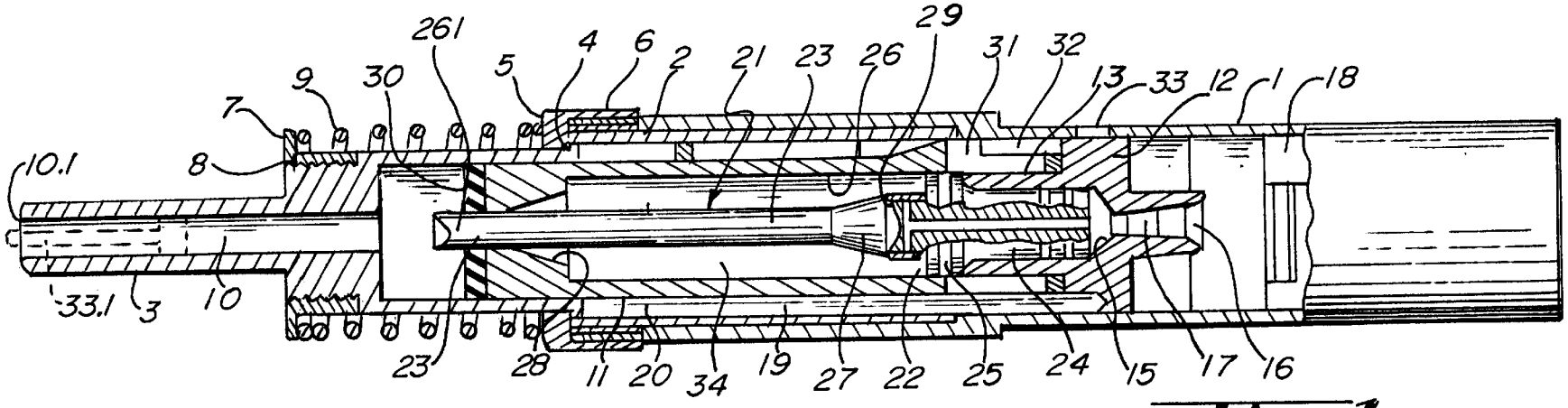
FIG. 1 shows a sectional detail of that part of a bolt-setting tool which is on the barrel side, in its starting position.

The explosive powder charge operated bolt-setting tool shown comprises a barrel-guiding sleeve 1 which accommodates an insert 2, in the form of a sleeve, on the mouth side in a fixed manner. The insert 2 accommodates a bolt guide 3 which can be displaced therein and is provided with a shoulder 4 which bears, in the starting position of FIG. 1, against an inwardly directed flange section 5 of a threaded piece 6 screwed on the mouth side onto the barrel-guiding sleeve 1. A helical spring 9 is clamped between the flange section 5 and an outwardly directed flange section 7 of a threaded piece 8 screwed onto the bolt guide 3, which helical spring pretensions the bolt guide 3 into the starting position FIG. 1.

The bolt guide 3 has a bore 10 for receiving a bolt to be fired, which bore is widened on that side which is remote from the mouth 10.1 in order displaceably to receive that end of a barrel-front part 11 which is on the mouth side, while the insert 2 serves as a safety stop for the barrel-front part 11, should the tool be operated without a bolt being loaded.

Furthermore, a barrel-rear part 12 is provided, this being inserted by an extension 13 into the barrel-front part 11 and there being formed therein a piston retainer 14 and a combustion space adjacent to a conical barrel base 15. The barrel-rear 12 is furthermore provided with a cartridge store 16 for receiving a cartridge, the cartridge store 16 being adjoined by a tapering bore 17 which leads into the barrel base 15. A locking part 18 having a cartridge-strip guide is located adjacent to the cartridge store 16.

The barrel-rear part 12 is connected to the bolt guide 3 via one or more connecting rods 19 in such a manner that the distance between the two can vary within predetermined limits which are determined by an axial groove 20, in which that end of the connecting rod 19 which is on the mouth side can be displaced. The connecting rod 19 expediently has hook-shaped ends with which it is fitted into the axial groove 20 or into a corresponding recess on the barrel-rear part 12.

Figure 3:
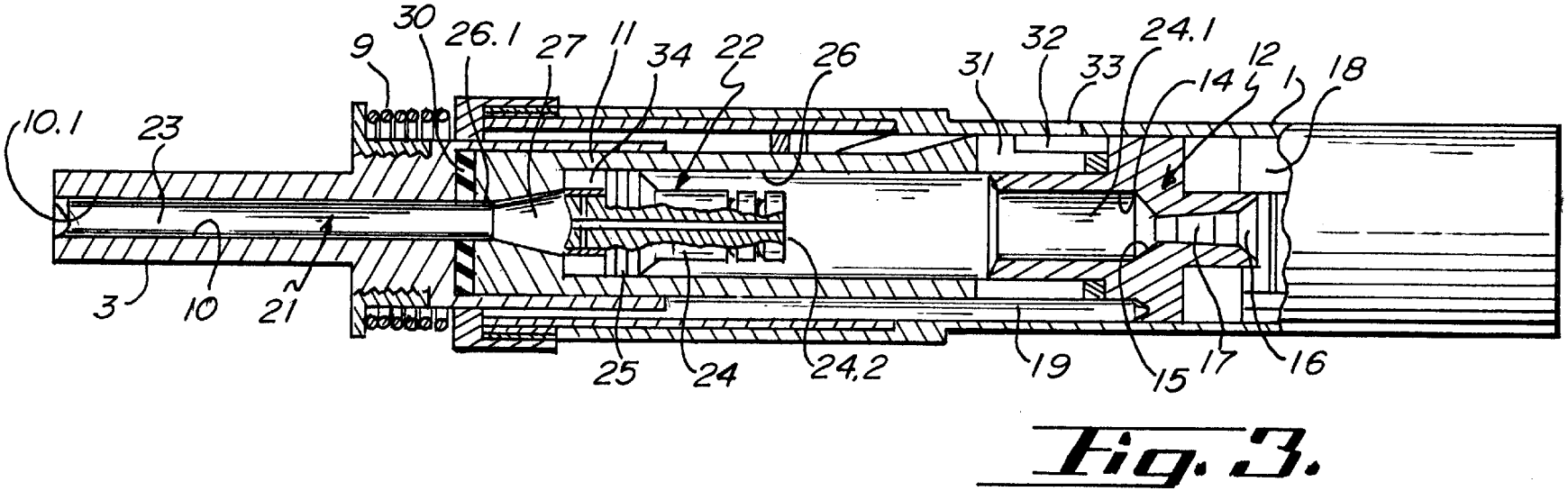

A piston 21 having a piston head 22 and a piston shank 23 is furthermore provided. The piston shank 23 can be displaced as far as the mouth side of the bore 10 of the bolt guide 3 (FIG. 3). The piston head 22 has a rear section 24 and rear side 24.1 which is accommodated in a first position chamber 24.2 in the starting position by the piston retainer 14 of the barrel-rear part 12, and a section 25 having an enlarged diameter, which is guided by the barrel-guiding bore 26 of the barrel-front part 11 and the piston receiving bore 26.1. Between the piston shank 23 and second section 25, the piston 21 has a transition piece with a conical end 27 on the mouth side which is assigned a conical retainer 28 at the end of the barrel-front part 11 which is on the mouth side, and a cylindrical section 29 which adjoins said end 27 and is adjacent to the section 25.

A damping washer 30 can be arranged at that end of the barrel-front part 11 which is on the mouth side, from which the piston shank 23 protrudes.

At its end which is in engagement with the barrel-rear part 12, the barrel-front part 11 is provided with a plurality of ventilation slots 31 which are distributed over its circumference and are virtually concealed by the section 25 of the piston 21 in the starting position of FIG. 1. The ventilation slots 31 lead into an annular space which is formed by a turned portion 32 at the end of the barrel-front part 11 and is surrounded by the barrel-guiding sleeve 1. The barrel-guiding sleeve 1 is provided with corresponding ventilation openings 33, so that the ventilation slots 31 can be connected to the outside.

Figure 4:
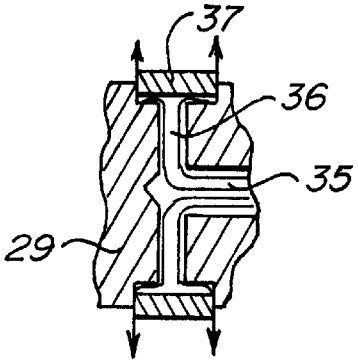
FIG. 4 shows a detail "A" of FIG. 2 on an enlarged scale.

A second chamber configured as an annular space 34 around the piston shank 23 in the barrel-guiding bore 26 is connected to the rear bore (first piston chamber) 35 the piston head 22 via an axial bore 35 and a transverse bore 36. The openings in the transverse bore 36 into the annular space 34 are located in the front cylindrical section 29 in front of the section 25 of the piston head 22, and are surrounded by an annular spring 37 which is accommodated with play by a corresponding groove in the section 29, cf. in particular FIG. 4.

Figure 2:
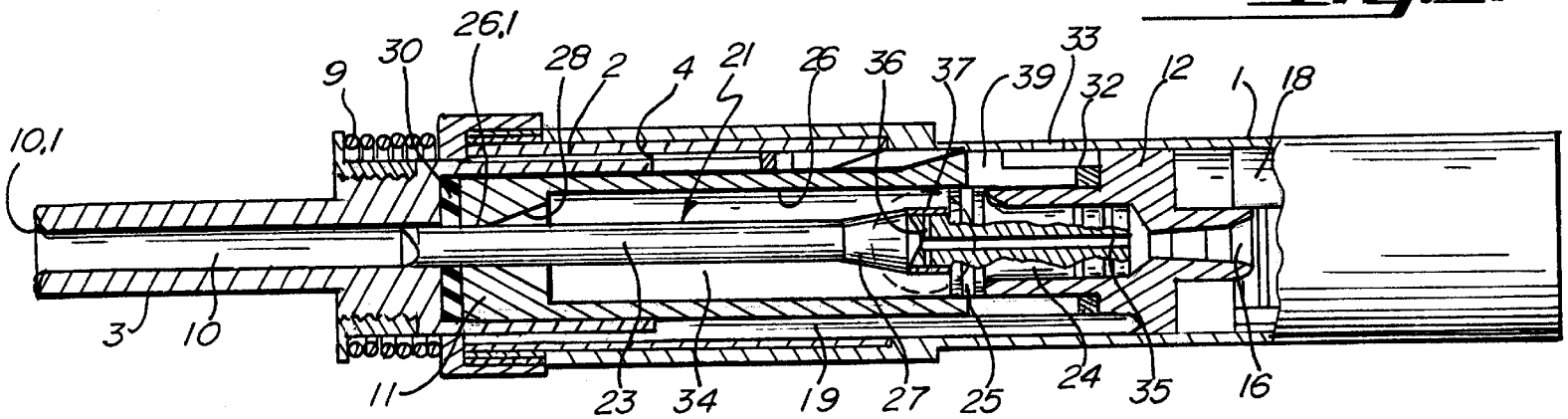
FIGS. 2 and 3 show the detail of the bolt-setting tool before the bolt-setting procedure and at the end of the bolt-setting procedure.

In order to fire a bolt, the bolt guide 3 receives a corresponding bolt 33.1. The bolt-setting tool is placed onto a wall or the like, into which the bolt is to be fired, and is brought into the shooting position by pressing against the wall (FIG. 2). By this means, the bolt guide 3 is pressed, counter to the force of the helical spring 9, into the barrel-guiding sleeve 1 until the helical spring 9 is pressed together, with the result that the barrel-front part 11 and barrel-rear part 12 are moved backwards, thereby enabling the cartridge store 16 to receive a cartridge and to be brought into a launching position with respect to the locking part 18.

By setting the cartridge, the resultant combustion gases cause the piston 21 in the barrel 11, 12 to move abruptly forward towards the mouth side, part of the combustion gases flowing, however, through the axial bore 35 and the transverse bore 36 into the annular space 34, which is being reduced by the piston movement. At the same time as this, the air in the annular space 34 is compressed by the combustion gases flowing in, until the conical end 27 reaches its retainer 28 in the barrel-front part 11 (FIG. 3). The bolt is then fired and the gas in the annular space 34 compressed.

Before this stage is reached, the ventilation slots 31 and outlet openings 33 have already been released to allow the combustion gases to escape, with the result that the rearside of the piston is connected to the outside, the pressure behind the piston 21 thereby correspondingly dropping. This release takes place whenever the section 24 of the piston head 22 has emerged from the barrel-rear part 12 and the piston 2 is correspondingly accelerated.

The volume of gas compressed in the annular space 34 is built up at the outlet side of the barrel-front part 11, owing to the annular space 34 being sealed with respect to the barrel-guiding bore 26 by the section 25 of the piston 21 and by the piston shank 23 and the adjoining, conical section 27, and intercepts the piston 21.

If the pressure in the annular space 34 exceeds the pressure at the rear side of the piston 21, the latter closes the outlet openings of the transverse bore 36 by corresponding pressing against the annular spring 37.

The volume of gas compressed in the annular space 34 expands again owing to the drop in pressure on the rear side of the piston and thereby guides the piston 21 back into its starting position in which the section 25 of the piston head 22 is accommodated by the barrel-rear part 12 and the section 24 of the piston head 22 is located adjacent to the barrel-rear part 12. Leakage losses at the sealing surfaces have, of course, to be kept sufficiently low that it is possible for the volume of gas acting as the gas spring in the annular space 34 to apply sufficient force in order to guide the piston 21 back into its starting position.

Release of the bolt guide 3 enables it to be guided back by the helical spring 9 into its starting position, thereby pulling, via the connecting rod(s) 20, the barrel-rear part 12 and also the barrel-front part 11 forwards into the starting position of FIG. 1, with the result that the barrel-rear part 12 is again at a distance from the locking part 18, i.e. the bolt-setting tool is reset after the shot into the starting position without repeating.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. An explosive powder charge operated bolt-setting tool comprising a barrel which has a barrel-guide bore and a mouth, is guided in a barrel-guiding sleeve and can be brought into operative engagement with a locking part, said barrel-guide bore accommodates a piston provided with a piston shank and piston head, said explosive powder charge operated bolt-setting tool further comprising a rear combustion chamber, a front chamber and a cartridge store, the cartridge store disposed on that side which is remote from the mouth, wherein a rear section of the piston head and the rear combustion chamber are connected through the piston to the front chamber and the piston front section by an axial bore defined in the piston head in such a manner that combustion gases are conducted from the combustion chamber through the axial bore to the front chamber via ventilated openings in a front side of the piston head, and wherein the piston head further comprises an annular spring disposed on an outer periphery of the front section to regulate combustion gases passing from the combustion chamber through the axial bore and ventilated openings to the front chamber and in that the barrel, on its side which faces the cartridge store, has ventilation slots which are released by the piston head as a bolt is being fired, before the piston reaches its end position on the mouth side, in which position a gas cushion is compressed between the piston head and the barrel, said gas cushion subsequently pressing the piston back into a starting position.

2. A tool according to claim 1, wherein the outlet openings are covered by the annular spring accommodated by a groove.

3. A tool according to claim 1, wherein the barrel includes a conical retainer for a conical section at the end of the piston shank.

4. A tool according to claim 1, wherein the barrel comprises a barrel-front part and a barrel-rear part, one of which is placed in the other and which can be moved axially with respect to one another.

5. A tool according to claim 4, wherein the barrel-front part and barrel-rear part respectively guide a section of the piston head, the ventilation slots in the barrel-front part being arranged adjacent to the barrel-rear part.

6. A tool according to claim 5, wherein the piston head includes a rear section with a diameter and a front section with a diameter, the rear section diameter being larger than the front section diameter.

7. A tool according to claim 1, further comprising a bolt guide, wherein the bolt guide, which is on the mouth side and can be traveled through by the piston shank, is guided in the barrel-guiding sleeve and is pretensioned with respect to the barrel-guiding sleeve by means for spring-pretensioning, the bolt guide and the barrel being coupled to one another in such a manner that they can be moved axially with respect to one another over a predetermined distance, and, by releasing the spring-pretensioning means, the bolt guide pulls the barrel into its starting position out of operative engagement with the locking part.

8. A tool according to claim 7, further comprising at least one connecting rod and wherein the bolt guide is coupled to the barrel via the at least one connecting rod.

9. A tool according to claim 1, further comprising a damping washer and wherein the barrel bears on the damping washer at its end which is on the mouth side.

10. An explosive powder charge operated bolt-setting tool comprising a barrel guiding sleeve, a barrel slidingly retained in said sleeve, and a piston slidingly engaged in said barrel, the barrel having a first piston chamber including a combustion chamber, a second chamber connecting thereto and a piston shank receiving bore connecting to the second chamber, the piston having a piston head including, a front side, a rear side, a first section sealingly engaged in the first piston chamber and a second section sealingly engaged in the second chamber, the piston further having a piston shank extending through the piston shank receiving bore, the rear section of the piston head being connected through the piston to its front section by an axial bore and ventilated openings such that some of the combustion gases in the first chamber are conducted to the front side of the piston head in the second chamber, and wherein the piston head further comprises an annular spring disposed on an outer periphery of the second section to regulate combustion gases passing from the first chamber through the axial bore and ventilated openings to the second chamber the barrel guiding sleeve having a bolt receiving bore and ventilation slots which are released by the piston head as the bolt is being set and in which position an air cushion is compressed in the second chamber by the second section thereby reversing the travel of the piston.

11. A tool according to claim 9, wherein the outlet openings are covered by the annular spring accommodated by a groove.

12. A tool according to claim 10, in which an end of the piston shank includes a conical section and wherein the barrel has a conical retainer accommodating the conical section at the end of the piston shank.

13. A tool according to claim 10, wherein the barrel comprises a barrel-front part and a barrel-rear part, one of which is placed in the other and which can be moved axially with respect to one another.

14. A tool according to claim 13, wherein the barrel-front part and barrel-rear part respectively guide a section of the piston head, the ventilation slots in the barrel-front part being arranged adjacent to the barrel-rear part.

15. A tool according to claim 14, wherein the piston head includes a rear section with a diameter and a front section with a diameter, the diameter of the rear section of the piston head being larger that the diameter of the front section of the piston head.

16. A tool according to claim 10, further comprising a bolt guide and wherein the bolt guide, which is on the mouth side and can be traveled through by the piston shank, is guided in the barrel-guiding sleeve and is pretensioned with respect to the barrel guiding sleeve by means for spring pretensioning, the bolt guide and the barrel being coupled to one another in such a manner that they can be moved axially with respect to one another over a predetermined distance, and, by releasing the spring-pretensioning means, the bolt guide pulls the barrel into its starting position out of operative engagement with the locking part.

17. A tool according to claim 16, further comprising at least one connecting rod and wherein the bolt guide is coupled to the barrel via the at least one connecting rod.

18. A tool according to claim 10, further comprising a damping washer and wherein the barrel bears the damping washer at its end which is on the mouth side.

* * * * *